US011555668B2

(12) United States Patent
Mills

(10) Patent No.: US 11,555,668 B2
(45) Date of Patent: Jan. 17, 2023

(54) HANDGUN HOLSTER FOR ATHLETIC USE

(71) Applicant: Angela Rae Mills, Cisco, TX (US)

(72) Inventor: Angela Rae Mills, Cisco, TX (US)

(73) Assignee: Angela Rae Mills, Cisco, TX (US)

( * ) Notice: Subject to any disclaimer, the term of this patent is extended or adjusted under 35 U.S.C. 154(b) by 43 days.

(21) Appl. No.: 17/186,349

(22) Filed: Feb. 26, 2021

(65) Prior Publication Data

US 2021/0180914 A1 Jun. 17, 2021

Related U.S. Application Data

(63) Continuation of application No. 16/400,940, filed on May 1, 2019, now Pat. No. 10,962,326.

(60) Provisional application No. 62/665,144, filed on May 1, 2018.

(51) Int. Cl.
*F41C 33/04* (2006.01)
*F41C 33/02* (2006.01)

(52) U.S. Cl.
CPC ..... *F41C 33/048* (2013.01); *F41C 33/0227* (2013.01)

(58) Field of Classification Search
CPC ..... Y10S 224/911; Y10S 224/904; Y10S 224/93; F41C 33/0227; F41C 33/041; F41C 33/046; F41C 33/0218; F41C 33/048
See application file for complete search history.

(56) References Cited

U.S. PATENT DOCUMENTS

| | | | | |
|---|---|---|---|---|
| 3,565,303 | A | 2/1971 | Kippen | |
| 3,977,582 | A | 8/1976 | McMahon | |
| 4,022,361 | A | 5/1977 | Devlin | |
| 4,258,871 | A | 3/1981 | McMahon | |
| 4,270,680 | A | 6/1981 | Bianchi | |
| 4,312,466 | A | 1/1982 | Clark | |
| 4,420,104 | A | 12/1983 | DiIenno | |
| 4,504,001 | A * | 3/1985 | Nichols | F41C 33/0227 224/198 |
| 4,591,081 | A | 5/1986 | Bianchi et al. | |
| D291,389 | S | 8/1987 | Crymes | |
| D293,628 | S | 1/1988 | Teachey | |
| 4,846,383 | A | 7/1989 | Gallagher | |
| 5,018,654 | A | 5/1991 | Rogers et al. | |
| 5,236,113 | A | 8/1993 | Wisser | |
| 5,282,559 | A | 2/1994 | Wisser et al. | |

(Continued)

OTHER PUBLICATIONS

U.S. Appl. No. 16/400,940 Non-Final Office Action dated Aug. 10, 2020.

*Primary Examiner* — Brian D Nash
(74) *Attorney, Agent, or Firm* — Wilson Sonsini Goodrich & Rosati

(57) ABSTRACT

The present invention provides a handgun holster apparatus comprising a body, first strap, and second strap each made from moisture-wicking layers and moisture-repellant layers. The holster further comprises at least four reversible fasteners: a first reversible fastener affixed to the first strap, a second reversible fastener affixed to the second strap, a third reversible fastener affixed to the front side of the body, and a fourth reversible fastener affixed to the back side of the body. The first and second straps each respectively has open strap positions and closed strap positions allowing for the handgun to be removable from the holster as well as the holster to be reversibly affixed to the inside of a garment.

19 Claims, 4 Drawing Sheets

(56) References Cited

U.S. PATENT DOCUMENTS

| | | | | |
|---|---|---|---|---|
| D344,630 | S | 3/1994 | Doerksen | |
| 5,318,821 | A * | 6/1994 | Bradley, Jr. | B65F 1/14 220/694.1 |
| 5,392,975 | A | 2/1995 | Blankenship, Jr. | |
| 5,441,187 | A | 8/1995 | Mixson | |
| 5,503,316 | A | 4/1996 | Stewart | |
| 5,535,928 | A | 7/1996 | Herring | |
| 5,687,891 | A | 11/1997 | Beletsky | |
| 5,820,003 | A * | 10/1998 | Nichols | F41C 33/046 224/575 |
| 6,056,174 | A * | 5/2000 | Minckler | A45F 5/02 224/901.4 |
| 6,209,769 | B1 | 4/2001 | Seals et al. | |
| 6,364,187 | B1 | 4/2002 | Castellano et al. | |
| 6,561,402 | B2 | 5/2003 | Holland et al. | |
| 7,690,542 | B1 | 4/2010 | Silvera | |
| 9,568,275 | B2 | 2/2017 | Sykes et al. | |
| 9,784,530 | B1 | 10/2017 | Myers | |
| 10,798,977 | B1 * | 10/2020 | Ransom | A41C 3/0035 |
| 11,022,402 | B1 * | 6/2021 | Scott | F41C 33/048 |
| 2007/0045364 | A1 | 3/2007 | Grundy et al. | |
| 2007/0068982 | A1 | 3/2007 | Grundy et al. | |
| 2012/0091175 | A1 * | 4/2012 | de Nijs | F41C 33/04 224/236 |
| 2013/0320055 | A1 | 12/2013 | King | |
| 2014/0027486 | A1 | 1/2014 | McGee et al. | |
| 2014/0097216 | A1 * | 4/2014 | Rogers | F41C 33/0227 224/243 |
| 2017/0105511 | A1 * | 4/2017 | Bryant | A45C 13/10 |
| 2018/0347941 | A1 | 12/2018 | Mandelbaum et al. | |
| 2019/0219360 | A1 | 7/2019 | Jwszenski | |
| 2019/0223580 | A1 | 7/2019 | Wasylko | |
| 2019/0339040 | A1 * | 11/2019 | Mills | F41C 33/041 |
| 2020/0370864 | A1 * | 11/2020 | Cochran | F41A 17/54 |

* cited by examiner

HANDGUN HOLSTER FOR ATHLETIC USE

CROSS-REFERENCE

This application is a continuation of U.S. application Ser. No. 16/400,940, filed May 1, 2019, which claims the benefit of U.S. Provisional Application No. 62/665,144, filed May 1, 2018, which applications are incorporated herein by reference in their entirety.

SUMMARY OF THE INVENTION

The present invention provides a handgun holster that may be comfortably worn reversibly affixed inside (rather than outside) a person's garment during exercise.

In some embodiments, the invention provides a holster for a handgun comprising a body having a front side and a back side permanently connected along at least one edge, defining an opening between the front side and the back side. The holster further comprises a first strap and a second strap both permanently connected to the back side of the body. The invention also comprises at least four reversible fasteners: a first reversible fastener affixed to the first strap, a second reversible fastener affixed to the second strap, a third reversible fastener affixed to the front side of the body, and a fourth reversible fastener affixed to the back side of the body. The first strap is configured to fold over the opening, allowing the first reversible fastener to engage with the third reversible fastener. The second strap is configured to fold over a garment worn by a person, allowing the second reversible fastener to engage with the fourth reversible fastener. This reversibly affixes the holster to the inside of the garment. The first strap and the second strap each comprises a moisture-wicking layer and a moisture-repellant layer. The body of the holster comprises a main moisture-wicking layer, main moisture-repellant layer, and main fabric layer.

In other embodiments, the invention provides a holster for a handgun comprising a body defined by a front side, a back side, and an opening. The body of the holster in turn comprises a main moisture-wicking layer, a main moisture-repellant layer, and a main fabric layer. The main moisture-repellant layer is disposed between the main moisture-wicking layer and the main fabric layer, with the main fabric layer defining an interior of the holster body and the main moisture-wicking layer defining an exterior of the holster body. The holster further provides a first strap permanently connected to the back side of the holster body via a fixed end and comprising a first moisture-wicking layer disposed on at least one surface of said strap. The holster also provides a second strap permanently connected to the back side of the holster body via a fixed end and comprising a second moisture-wicking layer disposed on at least one surface of the second strap. The holster also comprises a first reversible fastener affixed to the first strap, a second reversible fastener affixed to the second strap, a third reversible fastener affixed to the front side of the body, and a fourth reversible fastener affixed to the back side of the body. The first strap is moveable between a closed position and an open position. The closed first strap position is defined as wherein the first strap is folded over the opening and onto the front side of the body, allowing the first reversible fastener to engage with the third reversible fastener. The first strap open position is defined as wherein the first reversible fastener is disengaged from the third reversible fastener, thus uncovering the opening and allowing the handgun to be inserted or withdrawn from the holster. The second strap is also moveable between a closed second strap position and an open second strap position. The closed second strap position is defined as wherein the second strap is folded over onto the back side of the body, allowing the second reversible fastener to engage with the fourth reversible fastener and allowing the holster to be reversibly affixed to the garment. The open second strap position is defined as wherein the second reversible fastener is disengaged from the fourth reversible fastener and the second strap is oriented away from the fourth reversible fastener, allowing the holster to be removed from the garment.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the present invention are set forth with particularity in the appended claims. A better understanding of the features and advantages of the present invention will be obtained by reference to the following detailed description that sets forth illustrative embodiments, in which the principles of the present invention are utilized, and the accompanying drawings of which:

DETAILED DESCRIPTION OF THE INVENTION

The apparatus of the present invention provides a gun holster that can comfortably be worn immediately adjacent to the human body while protecting the gun from moisture (e.g. sweat or rain). In some embodiments, the gun holster is non-rigid and is adapted for being reversibly affixed inside a sports bra or inside a waistband.

Additionally, in some embodiments, the gun holster provides moisture protection to both the side of the gun facing toward the wearer and the side of the gun facing away from the wearer, as well as to the handle of the gun. This protects the gun from multiple avenues of moisture penetration (e.g. sweat through direct contact with the body, sweat which collects on the garment, and sweat which drips from the face or hair).

The various properties of the present invention allow for the holster to be reversibly affixed inside a garment and worn by a person engaged in physical exercise activities such as jogging, cycling, or weight lifting.

Figure 1:
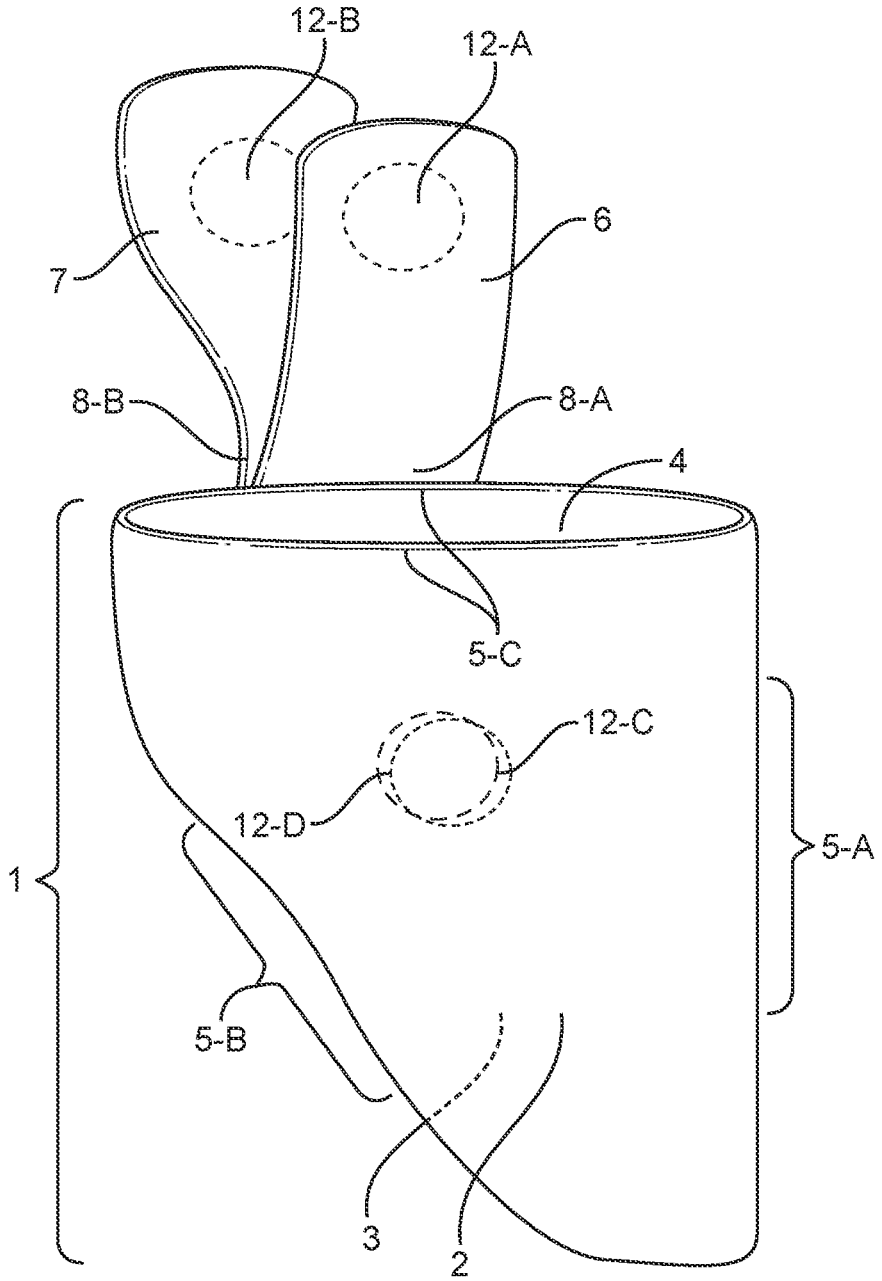
FIG. 1 is a front view of a gun holster apparatus in accordance with some embodiments of the present invention.

Referring to the figures herein, some embodiments such as depicted in FIG. 1 include a holster body 1 configured to receive a handgun 13. The holster body 1 has a front side 2 and a back side 3, the front side 2 being depicted in FIG. 1 and FIG. 2. The front side 2 and back side 3 are configured to form an opening 4 where the handgun 13 is received.

In some embodiments, the holster body 1 comprises three edges 5 substantially outlining the shape of an inserted handgun 13. A first edge 5-A correlates to the top of the inserted handgun 13; a second edge 5-B correlates to the muzzle and bottom of the inserted handgun 13; and a third edge 5-C correlates to the rear of the inserted handgun 13. In some embodiments, the second edge 5-B is curved or jagged. In some embodiments, the front side 2 and back side 3 of the holster body 1 are permanently connected along the first edge 5-A and the second edge 5-B, with the third edge 5-C forming the opening 4 for receiving the handgun 13.

In some embodiments, the front side 2 and the back side 3 are separate articles which are permanently connected along the first edge 5-A and the second edge 5-B by stitching.

In some embodiments, the front side 2 and the back side 3 are a single article having a bilateral fold along the first edge 5-A, the front side 2 and the back side 3 being permanently connected along the second edge 5-B by stitching.

In some embodiments such as depicted in FIG. 1, the holster comprises a first strap 6 and a second strap 7. Each of the first strap 6 and the second strap 7 has a fixed end 8 which is permanently connected to the back side 3 of the holster body 1. The first strap 6 is permanently connected at its fixed end 8-A, and the second strap 7 is permanently connected at its fixed end 8-B. In some embodiments, the first strap 6 and the second strap 7 are permanently connected to the back side 3 along the opening 4, which in the depicted Figures is also the third edge 5-C.

In some embodiments, the first strap 6 and the second strap 7 are configured so that when viewed from the front side 2 of the holster body 1, the first strap fixed end 8-A lays on top of the second strap fixed end 8-B and is nearer the opening 4.

In some embodiments such as depicted in FIG. 1, the holster comprises four reversible fasteners 12. A first reversible fastener 12-A is affixed to the first strap 6. A second reversible fastener 12-B is affixed to the second strap 7. A third reversible fastener 12-C is affixed to the front side 2 of the holster body 1. A fourth reversible fastener 12-D is affixed to the back side 3 of the holster body 1.

Figure 2:
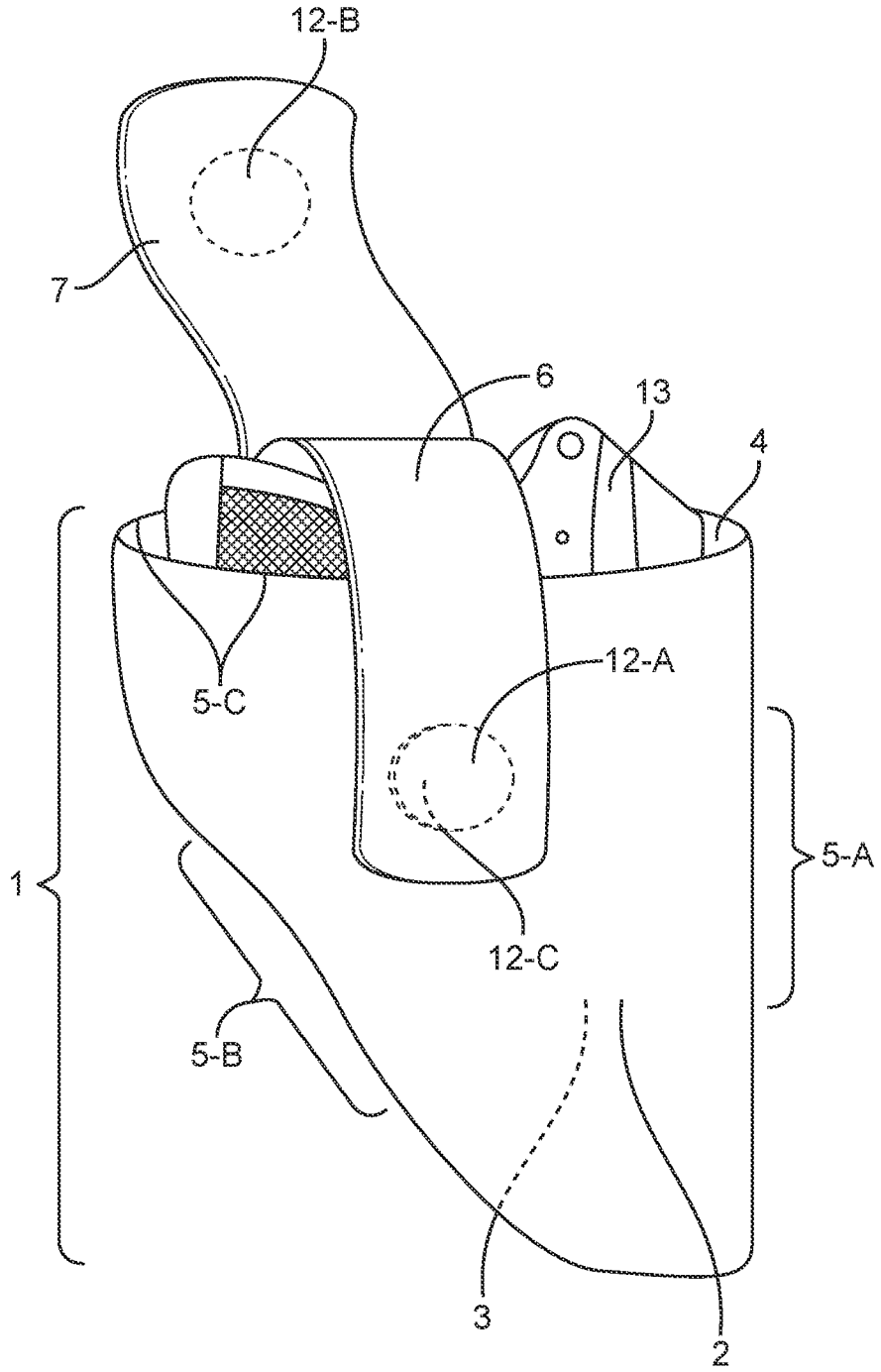
FIG. 2 is a front view of the gun holster apparatus in accordance with some embodiments of the present invention, shown with a gun inserted.

In some embodiments, the first strap 6 is movable between an open first strap position (depicted in FIG. 1) and a closed first strap position (depicted in FIG. 2). In the open first strap position, the first strap 6 is oriented away from the holster body 1 leaving the opening 4 uncovered. In the closed first strap position, the first strap 6 is folded over the opening 4 securing the handgun 13 inside the holster body 1, the first reversible fastener 12-A engaging with the third reversible fastener 12-C.

In some embodiments, the first reversible fastener 12-A and the third reversible fastener 12-C are magnets, snaps, press studs, hook-and-eye fasteners, toggles, buckles, clasps, or Velcro.

Figure 3:
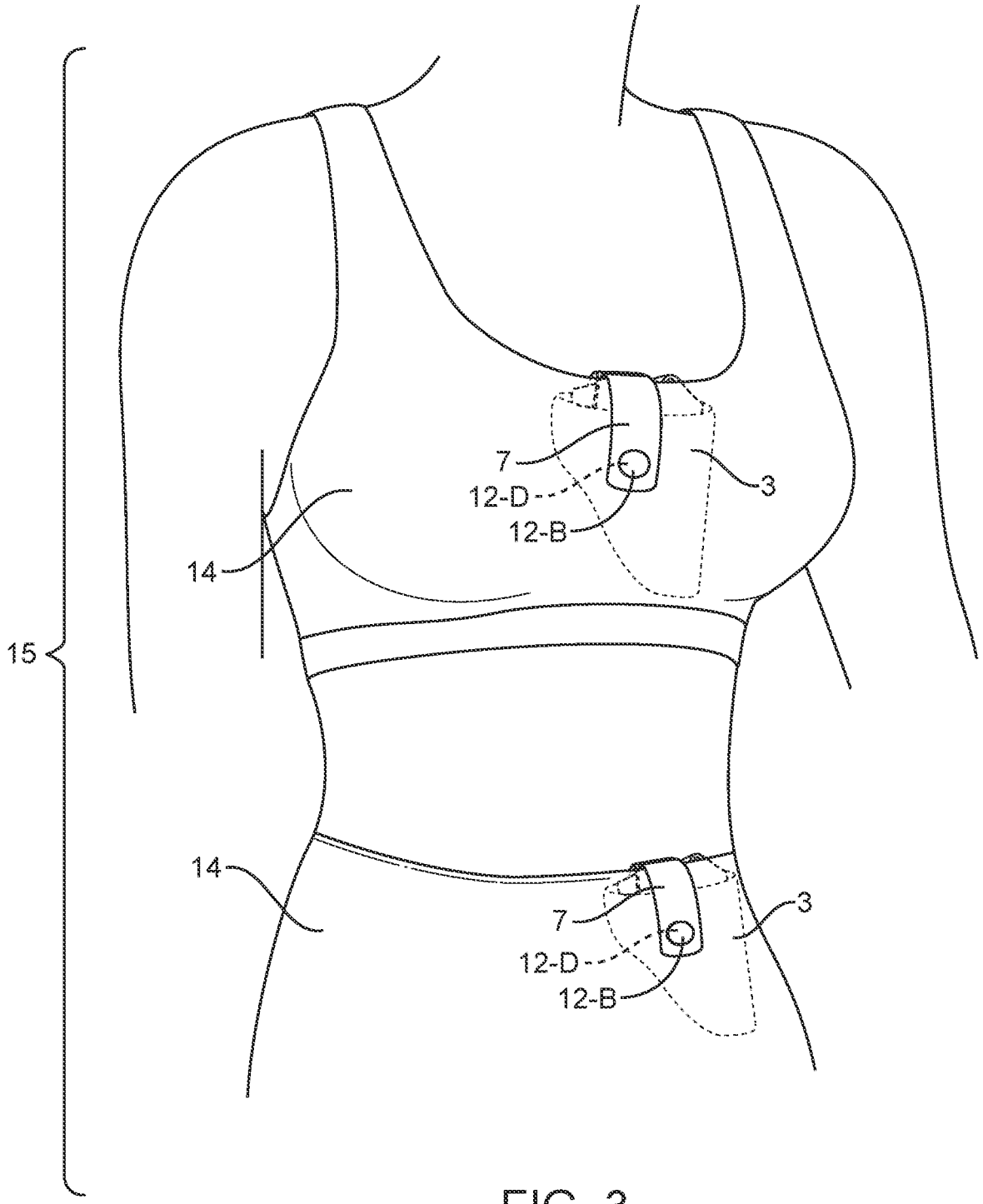
FIG. 3 is the gun holster apparatus in accordance with some embodiments of the present invention, shown being worn in two different positions on a person.

In some embodiments, the second strap 7 is movable between an open second strap position (depicted in FIG. 1 and FIG. 2) and a closed second strap position (depicted in FIG. 3). In the open second strap position, the second strap 7 is oriented away from the holster body 1. In the closed second strap position, the second strap 7 is folded over and onto the back side 3 of the holster body 1, and the second reversible fastener 12-B engages with the fourth reversible fastener 12-D, reversibly affixing the holster to a garment 14 worn by a person 15.

In some embodiments such as depicted in FIG. 3, the holster is configured to be reversibly affixed inside a sports bra or inside a waistband.

In some embodiments such as depicted in FIG. 3, the holster is configured to be worn so that the front side 2 faces toward the person 15, and the back side 3 faces away from the person 15. In some embodiments such as depicted in FIG. 1 and FIG. 2, the holster is configured for drawing the handgun 13 with the left hand. In some embodiments such as depicted in FIG. 3, the holster is configured for drawing the handgun 13 with the right hand.

In some embodiments, the second reversible fastener 12-B and the fourth reversible fastener 12-D are magnets.

In some embodiments, all four reversible fasteners 12 are magnets. In some embodiments, the third reversible fastener 12-C and the fourth reversible fastener 12-D are configured to engage with the handgun 13, further securing the handgun 13 inside the holster body 1. In some embodiments, the third reversible fastener 12-C and the fourth reversible fastener 12-D are configured to engage with each other when the holster body 1 is empty.

In some embodiments, the magnets are neodymium magnets.

In some embodiments, the holster has dimensions such that the first edge 5-A measures approximately 12 cm; the third edge 5-C measures approximately 12 cm; the second edge 5-B is curved and measures approximately 17 cm or more; the first strap 6 measures approximately 5 cm in width (as measured along the third edge 5-C) and approximately 7 cm in length; and the second strap 7 measures approximately 5 cm in width (as measured along the third edge 5-C) and approximately 9 cm in length.

Figure 4:
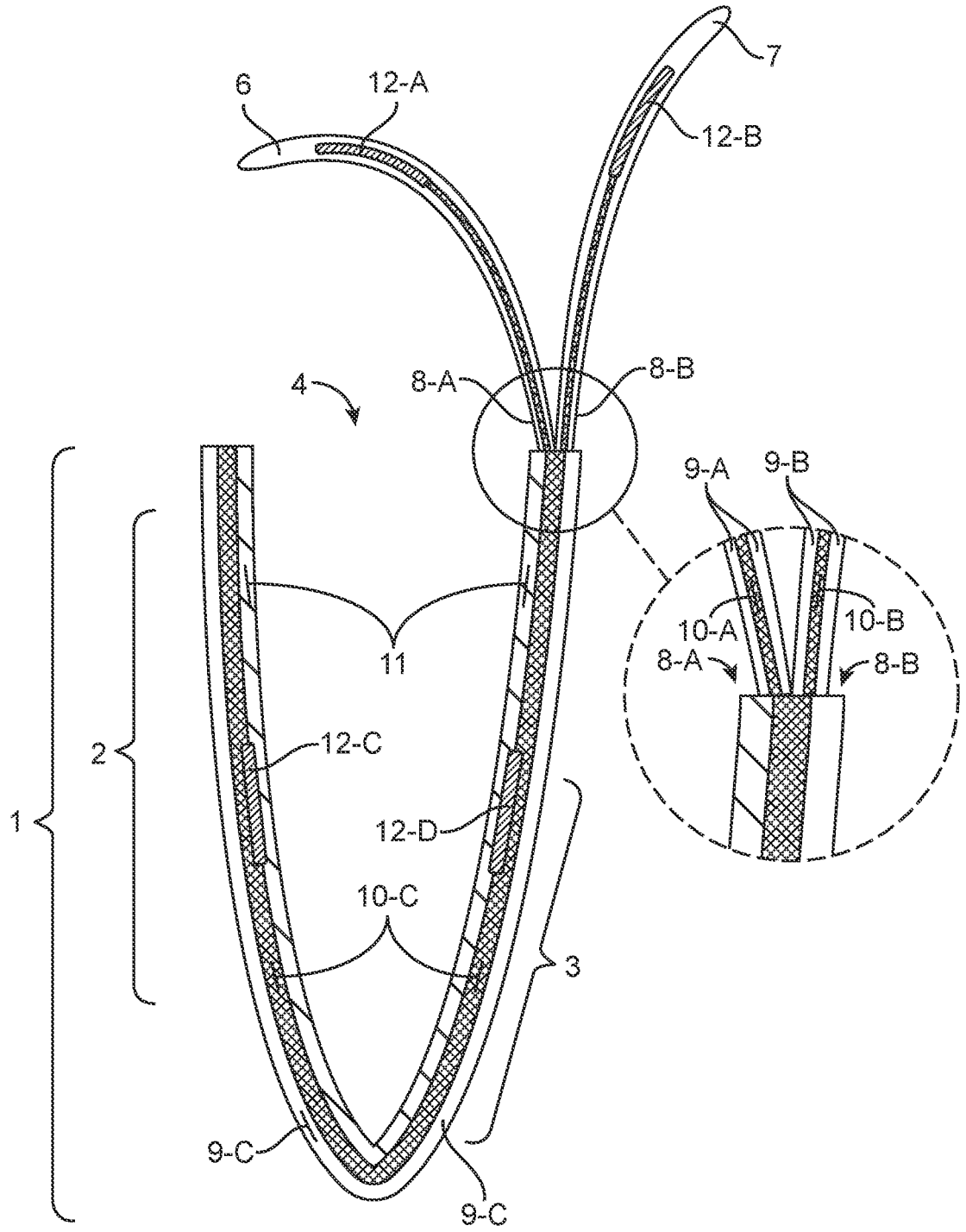
FIG. 4 is a cross-sectional view of the gun holster apparatus in accordance with some embodiments of the present invention, showing multiple layers of material and four reversible fasteners.

In some embodiments such as depicted in FIG. 4, the holster comprises multiple layers of material. In some embodiments, the holster comprises one or more moisture-wicking layers 9. In some embodiments such as depicted in FIG. 4, the first strap 6 has a first moisture-wicking layer 9-A, the second strap 7 has a second moisture-wicking layer 9-B, and the holster body 1 has a main moisture-wicking layer 9-C. In some embodiments, each of these moisture-wicking layers 9 is the same moisture-wicking material, but such is not necessary.

In some embodiments, the holster comprises one or more moisture-repellant layers 10. In some embodiments such as depicted in FIG. 4, the first strap 6 has a first moisture-repellant layer 10-A, the second strap 7 has a second moisture-repellant layer 10-B, and the holster body 1 has a main moisture-repellant layer 10-C. In some embodiments, each of these moisture-repellant layers 10 is the same moisture-repellant material, but such is not necessary.

In some embodiments such as depicted in FIG. 4, the holster body 1 further comprises a main fabric layer 11.

In some embodiments, the moisture-wicking layers 9 are synthetic fabrics comprising hydrophobic fibers which resist the adhesion of water. In some embodiments, the moisture-wicking layers 9 are one or more of polyester, polypropylene, wool, spandex, bamboo, Gore-Tex, and X-static.

In some embodiments, the moisture-repellant layers 10 are one or more of polyurethane laminate, thermoplastic polyurethane, a combination of nylon and polyester, laminated cotton, poplin, oilcloth, polyester fleece, microfiber, wool, vinyl, polyurethane leather, plastic, wax, and rubber. In some embodiments, the moisture-repellant layers 10 are polyurethane laminate.

In some embodiments, the main fabric layer 11 is muslin.

In some embodiments such as depicted in FIG. 4, the main moisture-wicking layer 9-C forms an exterior of the holster body 1. In some embodiments, the main fabric layer 11 forms an interior of the holster body 1. In some embodiments, the main moisture-repellant layer 10-C forms an intermediate layer disposed between the main moisture-wicking layer 9-C and the main fabric layer 11. This structure protects the main moisture-repellant layer 10-C from abrasions caused by repeated insertion and removal of the handgun 13

In some embodiments, the first moisture-wicking layer 9-A forms one or both surfaces of the first strap 6. FIG. 4 depicts the first strap 6 with both surfaces occupied by the first moisture-wicking layer 9-A. In some embodiments such as depicted in FIG. 4, the first strap 6 further comprises a first moisture-repellant layer 10-A. Further in some embodiments such as depicted in FIG. 4, the first moisture-repellant layer 10-A forms an intermediate layer disposed between the two surfaces of the first strap 6.

In some embodiments, the second moisture-wicking layer 9-B forms one or both surfaces of the second strap 7. FIG. 4 depicts the second strap 7 with both surfaces occupied by the second moisture-wicking layer 9-B. In some embodiments such as depicted in FIG. 4, the second strap 7 further comprises a second moisture-repellant layer 10-B. Further in some embodiments such as depicted in FIG. 4, the second moisture-repellant layer 10-B forms an intermediate layer disposed between the two surfaces of the second strap 7.

In some embodiments such as depicted in FIG. 4, the first reversible fastener 12-A is disposed within the first strap 6; the second reversible fastener 12-B is disposed within the second strap 7; the third reversible fastener 12-C is disposed within the front side 2 of the holster body 1, between the main moisture-repellant layer 10-C and the main fabric layer 11; and the fourth reversible fastener 12-D is disposed within the back side 3 of the holster body 1, between the main moisture-repellant layer 10-C and the main fabric layer 11.

In some embodiments, the layers (9, 10, 11) are lightweight and non-rigid such that the holster may comfortably be worn tucked inside a person's garment 14 during exercise.

An example method of manufacturing some holster embodiments is provided. The holster body 1 is assembled from three layers of material: a main moisture-wicking layer 9-C, a main moisture-repellant layer 10-C, and a main fabric layer 11. The layers are initially arranged main fabric layer 11, then main moisture-wicking layer 9-C, then main moisture-repellant layer 10-C. In this arrangement, the moisture-wicking side of the main moisture-wicking layer 9-C faces toward the main fabric layer 11. The first strap 6 and the second strap 7 are each assembled by folding a moisture-wicking layer over itself so that the moisture-wicking side is on the outside. The first reversible fastener 12-A and the second reversible fastener 12-B are each a magnet sewn into a fabric pouch. Each fastener is inserted into its respective strap, and the sides of the strap are sewn together. The straps (6, 7) are inserted between the main fabric layer 11 and the main moisture-wicking layer 9-C of the holster body 1, at a place that will define the third edge 5-C. The assembly is sewn along this edge and an opposite edge which will define a portion of the second edge 5-B. The holster body 1 is then turned inside-out so that the main moisture-wicking layer 9-C is on the outside, and the main fabric layer 11 is on the inside. The third reversible fastener 12-C and the fourth reversible fastener 12-D are each a magnet sewn into a fabric pouch. The reversible fasteners 12 are sewn into the holster body 1. The holster body 1 is then folded in half so that the main moisture-wicking layer 9-C is inside the fold and so that the third reversible fastener 12-C and the fourth reversible fastener 12-D are each in their respective sides. The holster body 1 is sewn along the second edge 5-B. The holster body 1 is then turned inside out so that the main moisture-wicking layer 9-C is on the outside.

While some embodiments of the present invention have been shown and described herein, it will be obvious to those skilled in the art that such embodiments are provided by way of example only. Numerous variations, changes, and substitutions will now occur to those skilled in the art without departing from the present invention. It should be understood that various alternatives to the embodiments of the present invention described herein may be employed in practicing the present invention. It is intended that the following claims define the scope of the present invention and that methods and structures within the scope of these claims and their equivalents be covered thereby.

What is claimed is:

1. A holster for a handgun, the holster comprising:

a body defining a front side, a back side, and an opening;

a first reversible fastener affixed to the front side of the body;

a first strap comprising a first strap fixed end and a first strap distal end, the first strap fixed end connected to the back side of the body;

a second reversible fastener affixed at the first strap distal end, wherein the first strap is movable between a closed first strap position and an open first strap position, wherein the closed first strap position comprises the first strap folded over the opening and onto the front side of the body and the second reversible fastener engaged with the first reversible fastener, and wherein the open first strap position comprises the second reversible fastener disengaged from the first reversible fastener;

a third reversible fastener disposed within the back side of the body;

a second strap comprising a second strap fixed end and a second strap distal end, the second strap fixed end connected to the back side of the body; and a fourth reversible fastener affixed to the second strap at a distal end; wherein the second strap is movable between a closed second strap position and an open second strap position, wherein the closed second strap position comprises the second strap folded over and onto the back side of the body and the fourth reversible fastener engaged with the third reversible fastener, and wherein the open second strap position comprises the fourth reversible fastener disengaged from the third reversible fastener;

wherein the front side and the back side each comprise a moisture-wicking layer, a moisture-repellant layer, and a fabric layer, the moisture-repellant layer being disposed between the moisture-wicking layer and the fabric layer, with the fabric layer defining an interior of the body, and the moisture-wicking layer defining an exterior of the body.

2. The holster of claim 1, where the third reversible fastener is disposed within the back side of the body between the moisture-wicking layer and the moisture-repellant layer.

3. The holster of claim 1, wherein the moisture-wicking layer comprises polyester, polypropylene, wool, spandex, bamboo, Gore-Tex, or X-static.

4. The holster of claim 1, wherein the moisture-repellant layer comprises polyurethane laminate, thermoplastic polyurethane, a combination of nylon and polyester, laminated cotton, poplin, oilcloth, polyester fleece, microfiber, wool, vinyl, polyurethane leather, plastic, wax, or rubber.

5. The holster of claim 1, wherein the first strap comprises a first moisture-wicking layer disposed on at least one surface of the first strap.

6. The holster of claim 1, wherein the second strap is oriented away from the third reversible fastener.

7. The holster of claim 1, wherein the body defines a substantially triangular shape comprising three edges, the front side and the back side being permanently connected along a first edge and a second edge, a third edge defining the opening.

8. The holster of claim 7 wherein the first edge of the body is defined by a bilateral fold in the body, the front side and the back side of the body being permanently connected along the second edge by stitching.

9. The holster of claim 8, wherein the first strap and the second strap are permanently connected to the back side of the body on the third edge, the first strap being disposed nearer the opening.

10. A holster for a handgun, the holster comprising:

a body having a front side and a back side, the front side and the back side permanently connected along at least one edge, defining an opening between the front side and the back side;

a first strap and a second strap, both permanently connected to the back side of the body;

a first reversible fastener affixed to the first strap;

a second reversible fastener affixed to the second strap;

a third reversible fastener affixed to the front side of the body; and a fourth reversible fastener affixed to the back side of the body, the first strap configured to fold over the opening, with the first reversible fastener engaging with the third reversible fastener, the second strap configured to fold over a garment worn by a person, with the second reversible fastener engaging with the fourth reversible fastener such that a portion of the garment is disposed between the second reversible fastener and the fourth reversible fastener, reversibly affixing the holster inside the garment;

wherein the back side of the body comprises two layers, and wherein the fourth reversible fastener is disposed between the two layers.

11. The holster of claim 10, wherein one of the two layers comprises a moisture-wicking layer, and wherein the other of the two layers comprises a moisture-repellant layer.

12. The holster of claim 11, wherein the moisture-wicking layer comprises polyester, polypropylene, wool, spandex, bamboo, Gore-Tex, or X-static.

13. The holster of claim 11, wherein the moisture-repellant layer comprises polyurethane laminate, thermoplastic polyurethane, a combination of nylon and polyester, laminated cotton, poplin, oilcloth, polyester fleece, microfiber, wool, vinyl, polyurethane leather, plastic, wax, or rubber.

14. The holster of claim 10, wherein the second reversible fastener and the fourth reversible fastener each comprise a magnet.

15. The holster of claim 10, wherein the first reversible fastener and the third reversible fastener each comprise a magnet, a snap, a press stud, a hook-and-eye fastener, a toggle, a buckle, a clasp, or Velcro.

16. The holster of claim 10, wherein the first strap is configured to fold over the opening thereby securing the handgun substantially inside the body.

17. The holster of claim 10, wherein the body, the first strap, and the second strap are non-rigid.

18. The holster of claim 10, wherein the front side and the back side are permanently connected along the at least one edge by stitching.

19. A holster for a handgun, the holster comprising:

a body having a front side and a back side, the front side and the back side permanently connected along at least one edge, defining an opening between the front side and the back side;

a first strap and a second strap, both permanently connected to the back side of the body;

a first reversible fastener affixed to the first strap;

a second reversible fastener affixed to the second strap;

a third reversible fastener affixed to the front side of the body; and a fourth reversible fastener affixed to the back side of the body, the first strap configured to fold over the opening, with the first reversible fastener engaging with the third reversible fastener, the second strap configured to fold over a garment worn by a person, with the second reversible fastener engaging with the fourth reversible fastener such that a portion of the garment is disposed between the second reversible fastener and the fourth reversible fastener, reversibly affixing the holster inside the garment;

wherein the front side and the back side are permanently connected along the at least one edge by stitching.

* * * * *